United States Patent [19]

Keller

[11] Patent Number: 4,510,837

[45] Date of Patent: Apr. 16, 1985

[54] METHOD OF MANUFACTURING A PIANO PLATE ASSEMBLY AND THE ASSEMBLY

[76] Inventor: Keith T. Keller, 3614 Woodlawn Ave. N., Seattle, Wash. 98103

[21] Appl. No.: 458,868

[22] Filed: Jan. 17, 1983

[51] Int. Cl.[3] ..... G10C 3/04; G10C 3/08

[52] U.S. Cl. ..... 84/184; 84/186 R; 84/188

[58] Field of Search ..... 84/184, 185, 186 R, 84/187, 188, 190, 192, 193

[56] References Cited

U.S. PATENT DOCUMENTS

| | | | |
|---|---|---|---|
| 540,298 | 6/1895 | Clark | 84/185 |
| 3,144,800 | 8/1964 | Salmons | 84/186 |

*Primary Examiner*—L. T. Hix
*Assistant Examiner*—Douglas S. Lee
*Attorney, Agent, or Firm*—Robert W. Jenny

[57] ABSTRACT

A plate assembly as herein disclosed can be constructed to be used in place of the plate assembly in any piano. It is constructed primarily of composite material and replaces the conventional cast iron plate or plate assembly. The assembly has better shape and dimensional stability under the influences of time, temperature variation and moisture, and is lighter weight and lower cost. These features allow use of a lighter weight piano frame. The net results are that a piano having optimum performance is more readily transported, its manufacturing and maintenance costs are less and the effects of time, temperature variation and moisture are minimal. The plate structure comprises specially designed and joined composite material elements, arranged to take best advantages of the characteristics of composite materials applied to serve the functional/structural purposes of piano plates.

33 Claims, 12 Drawing Figures

FIG. 3A
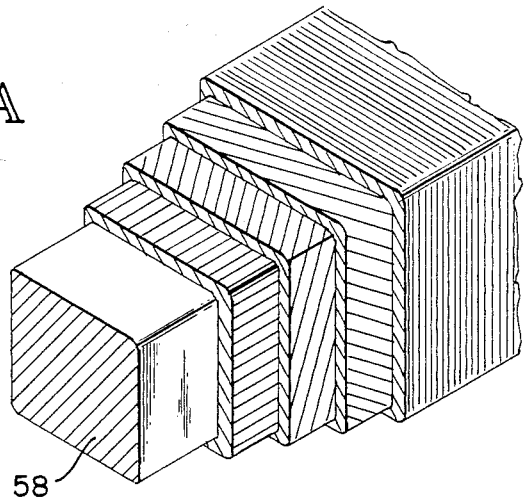
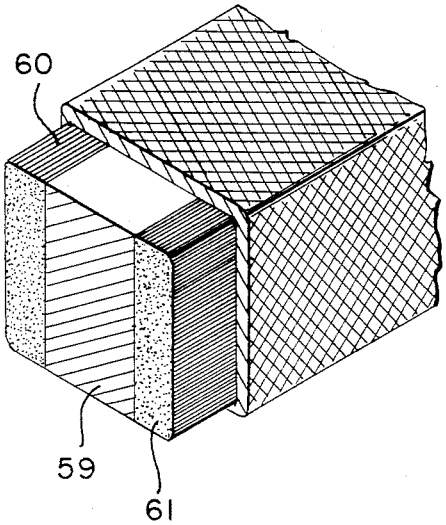
FIG. 3B
FIG. 4
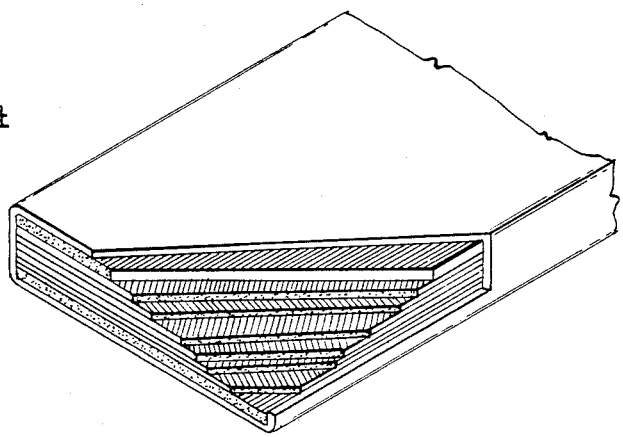

METHOD OF MANUFACTURING A PIANO PLATE ASSEMBLY AND THE ASSEMBLY

BACKGROUND OF THE INVENTION

1. Field of the Invention

The subject invention is in the fields of stringed instruments and composite material and structures. More specifically, it is in the field of that part of the structure of stringed instruments to which the strings are attached in order to provide, resist and maintain the tension forces in the strings. Still more specifically, the invention relates to the structural part in a piano which performs these functions, commonly known as the plate or plate assembly.

2. Discussion of the Prior Art

It is clearly evident from discussions with people skilled in the art and from study of pertinent literature and prior art patents that the design of pianos has evolved over many years. It is also evident that understanding of and theories and explanations about how the various elements and components of pianos function and cooperate in producing the music are varied. The qualities of the music are said to be a function of the interactions among the strings, the plate, the sounding board, the frame, the mechanisms for striking the strings and such detailed things as the degrees of stiffness and resilience in the pads of the hammers which strike the strings. There is general agreement, however, that the characteristics of the plate, the structure to which the strings are attached, have a fundamental influence on the quality and consistency of the music. Further, two of the more important characteristics are (1) structural stability in terms of dimensions and shape and (2) structural damping. The stability is needed in order for the piano to stay in tune, regardless of the effects of humidity, temperature, time and handling. The damping, according to well accepted theory and empirical determinations, is needed so that there will be minimal resonant vibrations in the structure since such resonances produce undesired sound and/or otherwise interfere with the production of sound by the strings.

Prior art plates are made of grey cast iron. With this material it is necessary, for all but the smallest, to use a rim type construction to limit flexing to acceptable amounts. Such construction is difficult and expensive and results in heavy, cumbersome plates. Furthermore, grey cast iron has low internal damping (i.e. it is elastically efficient) and tends to resonate in response to string vibration, particularly in the treble frequency range.

Another factor which adds to the cost of cast iron plates is that they are not amenable to mass production techniques, i.e. the castings must age and considerable, special hand work is required on each plate and its installation. This factor is largely attributable to the internal stresses inherent in iron castings. Because of these stresses castings have a strong tendency to change shape when the casting is machined or holes are drilled in it. Also, the shape changes as the stresses relieve with time. It is difficult to achieve uniformity in each casting and among castings.

In addition to the use of rim type construction to limit flexing, cast iron plates are often structurally integrated with a surrounding wooden structure known as a case. To effectively help limit flexing of the plate, the case itself is heavy and cumbersome and compounds the problems associated with cost and weight.

Examples of attempts to solve the problems of undesired resonance in the plate and excessive weight and cost can be found in the prior art. For example, U.S. Pat. No. 3,144,800 describes a pianoforte comprising a moulding and a wooden assembly. The moulding combines into one unit the frame (another term for plate) and the top, bottom and sides of the case. The wooden assembly is the back of the case and provides the resonance needed for proper operation of the instrument.

The moulding may also incorporate an element known as the key bottom and one or more bracing struts. It is pointed out that certain parts which are particularly highly stressed may be formed by winding glass fibre on a mandrel and impregnating the winding with resin. The mandrel may be metal or made of the resin treated glass cloth used in the rest of the plastic unit and remains as part of the unit.

Instruments made according to this patent have not become commercially successful and accordingly can be recognized as not providing a good solution to the problems described. This lack of success can be attributed to factors including the amount of hand work required in manufacturing the moulded unit, the difficulty of achieving uniformity among units even with the best affordable manufacturing efforts, the lack of applicability of the technology to a variety of types of pianos, and the use of glass fibre as the reinforcing material.

U.S. Pat. No. 3,562,027 addresses the problem of reduction of weight of the plate by design details and selection of materials (cast irons). It is claimed that cast iron having a tensile strength of at least 37 kg/mm$^2$ and an arbitrarily defined loss factor between certain limits can be used to produce lighter weight cast iron plates without sacrificing tonal qualities. The patent teaches the material technology, but not the design features made possible by the materials. The amount of weight saved is not indicated. Further, the cost of a plate made according to this patent would be higher than the cost of equivalent current state-of-the-art cast iron plates.

U.S. Pat. No. 3,564,963 illustrates the need for minimizing the effects of vibrations of the plates on the tonal qualities of the piano. This patent covers means for " - - - damping out the undesirable ringing modes of shock-excited metal structures - - - ". The damping means comprise metal masses positioned to contact the vibrating braces of the plate, with the metal masses cushioned in dead rubber. Such means are an add-on feature and accordingly add to the cost of the piano. Also the means must be specially designed and properly adjusted to suit each type of piano and each piano of any type. This adds further to the cost and the effectiveness is vulnerable to the correctness of the adjustment and any effects temperature changes and time may have on the adjustments.

U.S. Pat. No. 4,144,792 reflects a different school of thought about how pianos function. In this case the theory is that the vibrations of the plate improve the operation of the instrument and the patent relates to improved means for casting the plate and to shaping of its surfaces to improve its vibration characteristics and aesthetics. The teaching of other patents and of experience in the field raise serious doubts about the validity of the theoretical approach. However, what constitutes good operation of the instrument is a matter of subjective judgment. High quality operation can be achieved when the vibrations of the plate, for whatever reason, are involved to as little extent as possible in the operation of the instrument. Minimizing or eliminating effects of plate vibration on instrument operation is much more readily accomplished than attempting to achieve, with good consistency, particular vibratory cooperation among the strings and sections of the plate.

U.S. Pat. No. 4,145,948 relates to a stringed musical instrument and particularly to the structural element which supports the strings and which reacts the forces generated by the tension of the strings. The structural element, the neck of a guitar for example, is made of graphite fiber reinforced plastic material. This material replaces wood and is described as providing a neck which is lighter but stiffer than the equivalent wooden neck as well as being more stable dimensionally under the influences of temperature and humidity variations. This dimensional stability, in combination with the minimal vibrational resonance of the neck, provide improved and stable acoustic tonal qualities. It is obvious that the benefits of using graphite fiber reinforced plastic material in a guitar could be realized by using such material in other stringed instruments, such as pianos. Other advantages which result from doing so, as described herein, are not obvious, particularly if the composite material is used to replace cast iron instead of wood. The other benefits include, as stated elsewhere, reduced weight and cost, neither of which would be particularly relevant to a guitar or similar small instrument.

Other prior art, related but of more general interest, includes the following U.S. Patents:

U.S. Pat. No. 3,656,395
U.S. Pat. No. 3,805,663
U.S. Pat. No. 3,943,816
U.S. Pat. No. 4,084,476
U.S. Pat. No. 4,119,009
U.S. Pat. No. 4,121,492
U.S. Pat. No. 4,144,793
U.S. Pat. No. 4,161,130
U.S. Pat. No. 4,200,023
U.S. Pat. No. 4,131,362

SUMMARY OF THE INVENTION

In view of the longstanding unmet need, as evidenced by the prior art, for less expensive, lighter weight pianos capable of high quality performance, it is a primary objective of the subject invention to provide piano plate assemblies which are economical, light weight, heavily damped, structurally stable and structurally self sufficient to the extent that associated structure of the piano can also be lighter in weight and less expensive.

Further, it is an objective of this invention that the plate assembly be adaptable to a variety of types of pianos and, accordingly, to be able to be used in place of the plates in conventional pianos.

Another object of this invention is that the plate assembly and its components be adaptable to mass production techniques rather than requiring relatively large value added in terms of handwork, particularly handwork requiring special skill and close quality control in order to achieve reasonable consistency in the product and its contribution to the operation of the instrument.

In accordance with these objectives the subject piano plate assembly comprises bars, plate elements commonly known as webs, joint fittings, fasteners and other elements common to piano plates. All of the components of the assembly except the fittings and fasteners are made of graphite fiber reinforced plastic material, otherwise known as composite material. In the implementation of the invention described in detail in this application the bars are tubes of rectangular crossection and having a high density plastic foam core. The elements are joined into an assembly by the fittings and fasteners and by adhesive bonding as well. Holes in the webs for the hardware used to attach the strings to the plate assembly are made by punching holes into the structure and placing parts in the punched holes in the exact shapes of the holes and in the proper locations and alignments in the uncured structure and then removing the parts after the structure is cured. In this way the resin structure is not disturbed by drilling or machining, thus aiding the structural integrity of the part.

As is characteristic in the design of fiber reinforced plastic material structure, the directional orientations of the fibres and the amounts of fibres in each direction are determined so that entirely adequate stiffness and/or strength are achieved efficiently relative to the weight of the structure and to the material and manufacturing costs.

Plate assemblies designed and constructed as described and according to the invention are strong and stiff relative to their weight and considerably lighter than equivalent cast iron plates. They are structurally stable, being free of internal stresses and virtually insensitive to changes in temperature and humidity. Because of the relative simplicity of each element and the use of established manufacturing techniques the parts and assemblies are predictably consistent within narrow limits, a factor which greatly facilitates mass production and the associated benefits in terms of cost reduction. Because there is no metal except in the fittings and fasteners and because the material is characterized by high internal damping, particularly with a dense foam platic core, very little energy is absorbed from the strings, virtually no resonant tonal influences are generated from the plate structure and the tonal quality of the music produced is accordingly high and consistent. Further, the structural consistency and stability of the plate assembly permit using lighter associated case structure and allow mass production assembly of the plates assemblies with their cases rather than requiring match drilling and the use of spacers as needed with cast iron plates. In summary, plate assemblies made according to the subject invention meet all the stated objects and enable meeting the long felt need for lighter weight, less expensive pianos capable of highest quality performance.

BRIEF DESCRIPTION OF THE DRAWINGS

FIGS. 3A–3B, View A schematically illustrates the composite structure of one form of bar according to the present invention. View B illustrates a second form.

FIG. 4 schematically illustrates the composite structure of a plate element according to the present invention.

DESCRIPTION OF A PREFERRED EMBODIMENT

Figure 1:
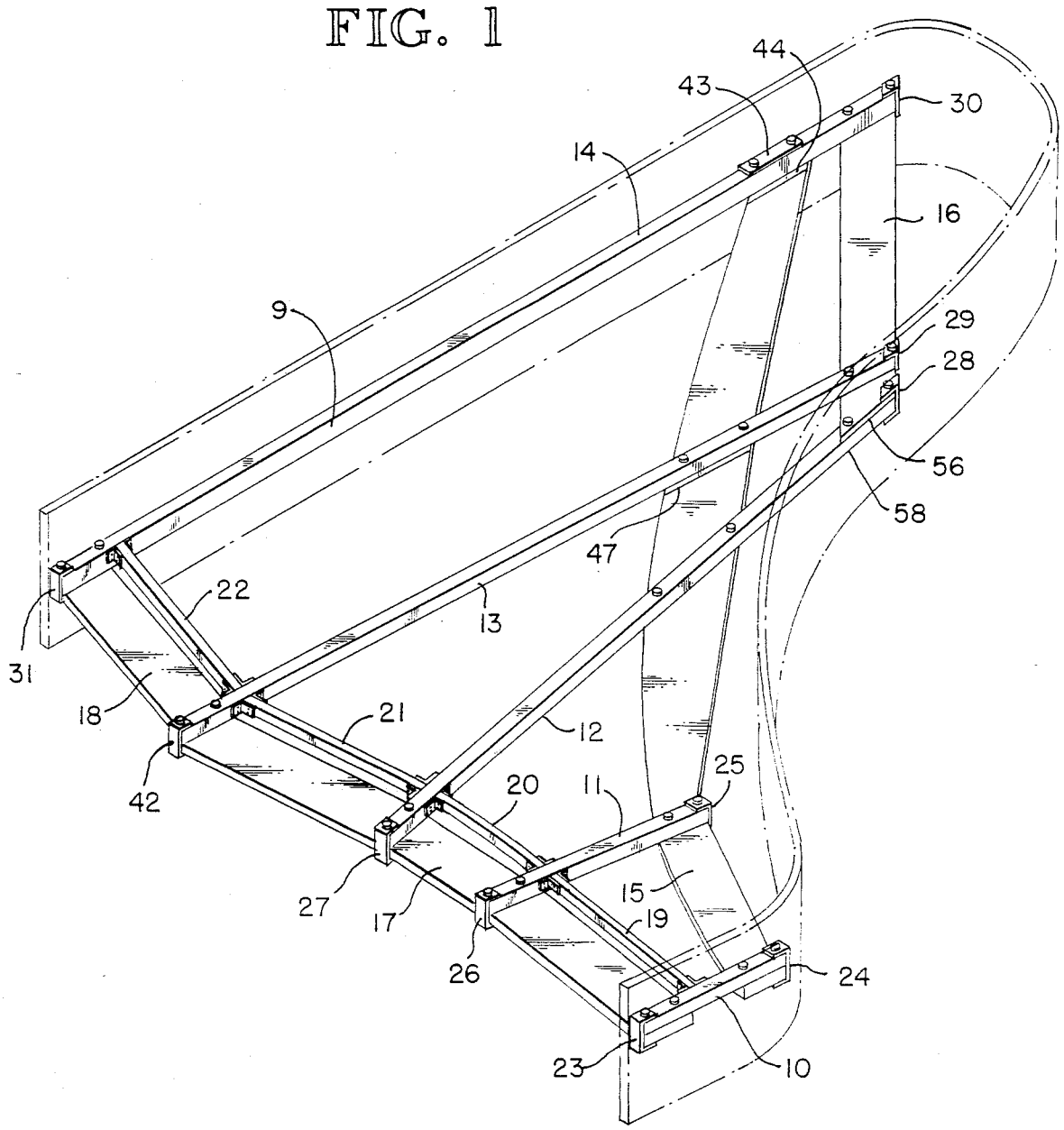
FIG. 1 is a perspective view of a complete plate assembly for a grand piano. Structure associated with the plate assembly is shown in phantom lines.
Figure 2A:
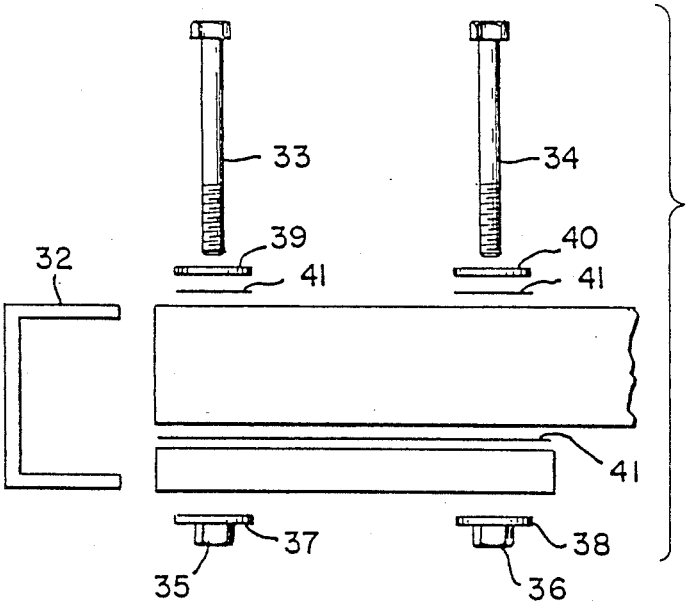
FIGS. 2A–2D illustrate the details of the attachment of a bars to a plate members. View A is an exploded view, illustrating all the elements of one type of attachment. View B shows the completed attachment. View C shows a completed attachment of another type used in the preferred embodiment of the subject investment. View D illustrates a third type of attachment.
Figure 2B:
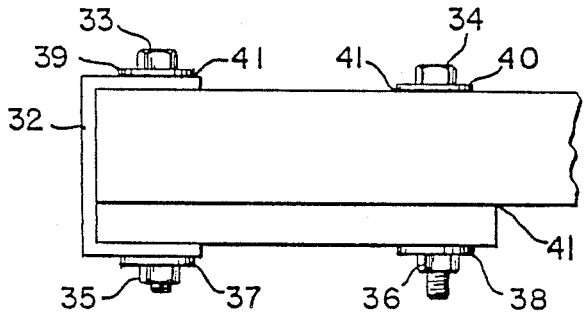
Figure 2C:
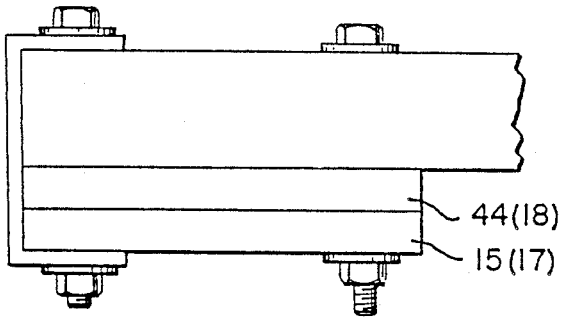
Figure 2D:
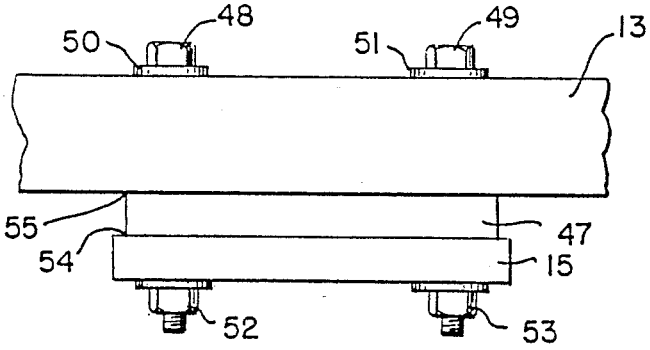

Referring more specifically to FIG. 1, the plate assembly 9 comprises bars 10, 11, 12, 13 and 14, plate elements 15, 16, 17 and 18 and capo d'astros 19, 20, 21 and 22. The attachments of bars to plate elements at attachment points 23,24,25,26,27,28,29,30 and 31 are illustrated in FIG. 2. As indicated in View A, FIG. 2, one form of attachment requires a fitting 32, two bolts 33 and 34, nuts 35 and 36, washers 37,38,39 and 40 and adhesive applied as indicated by the lines 41 between the parts which are to be adhesively bonded. A preferred adhesive is epoxy resin which is commercially available in a variety of forms. A preferred form is epoxy resin sheet from which pieces of appropriate shapes are manufactured, assembled in place and then cured by raising the temperature of the adhesive and assembly a specified amount for a specified time. The surfaces of the metal fittings are specially treated to facilitate the necessary bond strength with the adhesive. The technology related to adhesive bonding is well known in the art and available from commercial suppliers of the adhesives.

View B of FIG. 2 is a sectional view of a typical assembled attachment of a bar to a plate element. The parts are numbered the same as in view A.

View C illustrates the type of attachment at points 42 and 43 in FIG. 1, in which spacer 44 is used at point 43 and, at point 42, there are two plate elements, 17 and 18, in the attachment instead of one. Otherwise the attachment is similar to that shown in Views A and B.

The type of attachment shown in View D is used at points 45 and 46 in FIG. 1. In these two attachments the bars 12 and 13 extend across a plate element 15 and, at point 46, bar 13 is separated from plate 15 by spacer 47. The attachment at point 46 is shown in this view and comprises bar 13, spacer 47, plate element 15, bolts 48 and 49, washers 50 and 51, nuts 52 and 53 and layers of adhesive 54 and 55.

The attachment at point 56 in FIG. 1 is modified from the type shown in View A of FIG. 2 in that the bar 12 incorporates step 57 to accept plate element 16 at a position dictated by the fact that plate element 16 is in a different plane than plate elements 15 and 17 by a distance equal to the equal thicknesses of spacers 44 and 48 and plate element 18.

Referring more specifically to FIG. 3, and the details of the form of bar shown in View A, the bar is manufactured by applying laminations of resin impregnated graphite fibres over and around the mandrel 58. Mandrel 58 can be a composite material tube, a metal tube, a solid bar or any equivalent. In the illustration the mandrel is a solid bar of high density foamed plastic, weighing about 5 lbs per cubic foot. It has, for example, a square crossection 1 inch on a side. In some laminations the fibres run lengthwise of the mandrel (0° orientation), in some at 45° (−45° orientation) and some at essentially 90° to the mandrel centerline.

As is known in the art, the characteristics of composite structural members are determined to a significant degree by the ratios of percentages of fibres oriented in the various directions. The wall or part thickness is then made up of enough laminations to provide the desired thickness with the appropriate mix of 0°, +45°, −45° and 90° plies. A preferred mix of fibre orientations for one form of bars of the subject invention is: 60% 0° plies, 15% −45° plies, 15% +45° plies, and 10% 90° plies. This general arrangement of plies is shown in View A, FIG. 3.

In the form of bar shown in View B, FIG. 3, a large percentage of the fibres are in the 0° orientation. The bar comprises a sandwich of a high density foam member 59 flanked by members 60 and 61, the three members being wrapped by fibres interwoven at +45° and −45°. As shown, the fibres in members 60 and 61 are all in the 0° orientation. A predominant characteristic of a bar made as described is high compressive strength relative to the weight of the bar.

FIG. 4 illustrates the typical composite structure of plate members 15, 16, 17 and 18 in FIG. 1. In these members a preferred mix of fibre orientations is 20% −45°, 20% +45°, 30% 0° and 30% 90°. The salient characteristics of structure having this mix of fibre orientations are good torsional and bending stiffness relative to weight.

Figure 5:
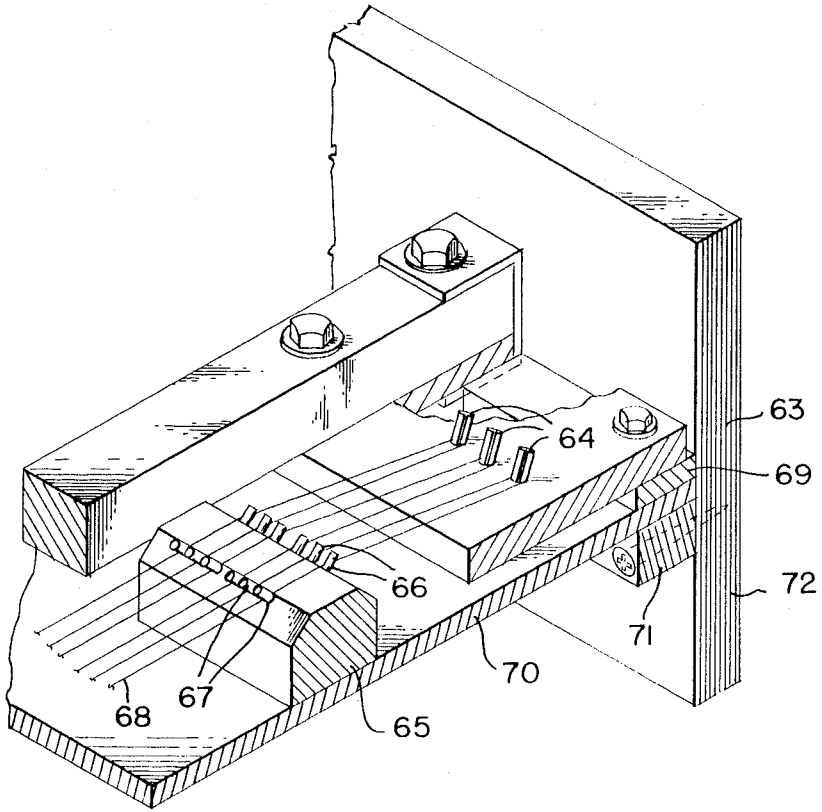
FIG. 5 is a sectional view illustrating the structural interconnection of the plate assembly, the sounding board and the piano case and also the hitchpins, bridge, bridge pins and strings at their hitch pin ends.

Referring to FIG. 5, which illustrates the structural interconnection of the plate assembly 9, the sounding board 70 and the piano case 63 and also the details and locations of hitch pins 64, a bridge piece 65, bridge pins 66 and 67, strings 68 and string arrangement at their hitch pin ends. Bar 11 and plate member 15 represent the plate assembly and are attached to each other as shown in View A, FIG. 2. Plate member 15 is bolted to spacer 69, sounding board 70 and cleat 71. The cleat is fastened to part 72 which is part of the piano case. All these fastenings may be supplemented by adhesive bonding. Hitch pins 64 and bridge pins 66 and 67 are commercially available rolled steel pins known as Rollpins. The bridge pins are pressed into holes drilled into the wooden bridge pieces. The hitch pins are installed in the plate elements by a method described later in this specification. Bridge piece 65 is adhesively bonded to the sounding board. As is well known in the art, the bridges and sounding board serve to transduce the energy of the vibrations of the strings into the acoustic energy which constitutes the music produced.

Figure 6:
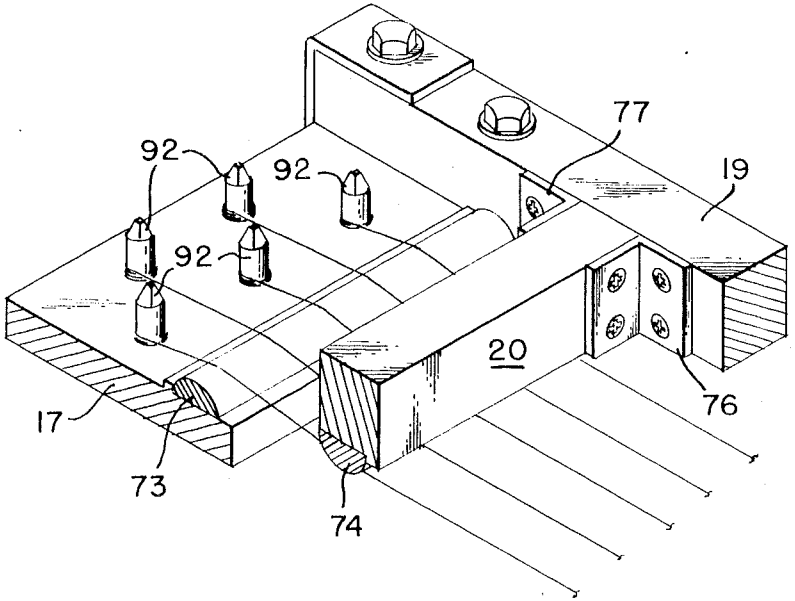
FIG. 6 is a sectional view of a wrest plank web, tuning pins, strings at the tuning pin end, string bearing point members on the web and capo d'astro and the capo d'astro itself.

FIG. 6 shows details of the plate assembly 9 at the interconnection of bar 12, plate element 17 and capo d'astro element 20. Tuning pins 92 fit into holes in the plate element, the holes being formed by the method described later in this specification. The plate elements fitted with the tuning pins are known in the industry as wrest webs. Conventionally the wrest webs are cast iron and supported by laminated wooden structure which receives and holds the tuning pins. In the subject invention no wooden reinforcement is needed. The tuning pins are received and held directly by the wrest web. The result is avoidance of variations in tuning pin location and alignment caused by the effects of temperature and moisture variations on the wooden substructure, in turn caused by the hygroscopic nature of wood. Half round metal parts 73 and 74 provide string bearing points on the wrest web 17 and capo d'astro element 20 respectively and are mechanically and adhesively fastened in place. Capo d'astro element 20 is attached at its ends to adjacent bars, the fastening technique shown being one example for the attachment. Angles 76 and 77 are adhesively and mechanically fastened to the capo d'astro element and bar(s).

The capo d'astro performs multiple functions. It supports the bearings point for one end of the speaking length of the string, the other end being the bridge. It must provide the half round bearing points for each of the strings in the proper point for each string, the line of points forming a curve in some instances. It must be located such that the angle of the strings between the wrest web and capo d'astro bearing points is such that low frequency sympathetic vibrations in the rest of the strings are adequately damped. Because, as is well accepted in the art, it is highly desirable that the energy of the vibrating strings be directed as much as possible to the bridge for transduction into acoustic energy, the energy absorption at the capo d'astro must be minimized. It is therefore helpful if the material from which the capo d'astro is made has high internal damping. This is a characteristic of composite materials. It will be helpful, further, for the capo d'astro to have considerable mass for its size; i.e. high specific gravity. With these factors in mind a preferred construction for capo d'astro elements is composite material laminated around a heavy metal core which serves as a mandrel. The fibres of the composite material are oriented to provide optimum bending and torsional stiffness relative to the selected thickness of the composite material. Lead is an acceptable core material although molded plastic loaded with particles of lead or other heavy metal may be used.

Figure 7:
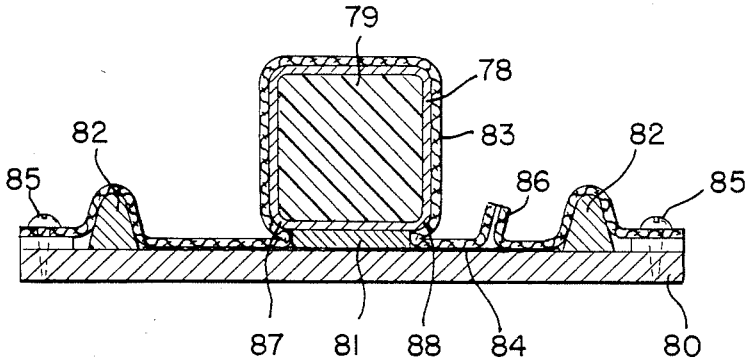
FIG. 7 illustrates the tooling used during the manufacture of a bar.
Figure 8:
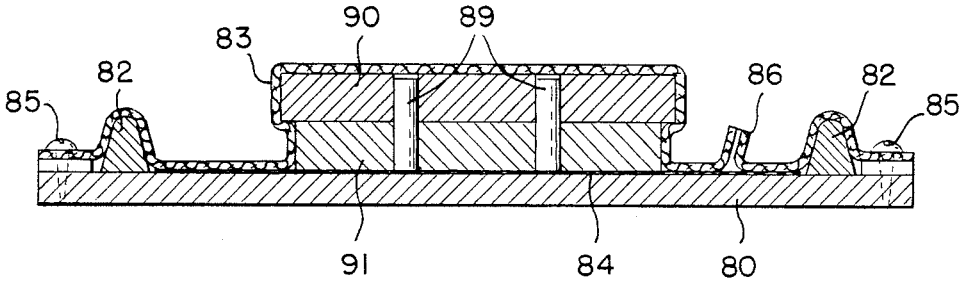
FIG. 8 illustrates the tooling used during the manufacture of a plate element.

FIGS. 7 and 8 relate to tooling and manufacturing techniques used in the manufacture of the primary components of the plate assembly, i.e. the bars and the plate elements. Referring to FIG. 7 a typical bar 78 is shown in crossection and comprises a core (mandrel) 79 of high density foam surrounded by laminations (plies) of resin saturated graphite fibres. The fibres are commercially available in tape and fabric form and with a variety of characteristics including fibre sizes, numbers of fibres per square inch of crossection, orientations of fibres, dimensions of the tape or cloth and kinds of resins with which the fibres are impregnated. As is usual in the manufacture of composite parts, in this case the impregnating resin is not fully cured when the plies are laid up on the core. For curing, the core and plies are subjected to heat and pressure in the apparatus shown schematically in FIG. 7. The apparatus comprises a base 80, a spacer 81, barrier parts 82 which completely surround the bar, a flexible vacuum bag 83, bleeder cloth 84 and bag retaining apparatus 85. Bag 83 is equipped with a fitting 86. When the bag is held in contact with the barrier parts, the air inside the bag and barriers can be extracted through the fitting, creating a partial vacuum so that atmospheric pressure forces the bag to tightly surround the bar, pressing the composite material against the core.

The spacer is somewhat narrower than the width of the bar. The result is that the bag is forced around the lower corners 87 and 88 of the bar to prevent rippling at the corners. The complete apparatus is raised to a predetermined temperature for a predetermined period of time to effect the curing of the composite material.

The apparatus in FIG. 8 for manufacturing plate elements is the same as that in FIG. 7 in all respects except that pins 89 have been placed in holes punched in the uncured composite material 91 and are accurately positioned and aligned by metal plate 90. In some plate elements the pins are hitch pins and will be permanently held in place by the resin during the curing process. In other plate elements the pins are parts sized, shaped and aligned to form holes for the later installation of tuning pins. The dimensions and shapes of these parts take into account the effects of temperature and temperature changes. These parts and the lower surface of the plate are coated with parting compound to permit removal of the plate and pins from the cured and completed plate element. An alternate is to make the parts from Teflon. The use of the plate, aside from assuring accurate alignment and location of the pins, assures that the surface of the plate element will be flat and smooth if the plate is smooth. Alternatively, the plate lower surface can be patterned to provide a decorative pattern on the surface of the plate element.

Certain features of the described tooling are covered by U.S. Pat. No. 4,287,015, issued to Harold J. Danner and are obviously not claimed as part of the subject invention.

From consideration of the described invention, it is clear that the subject invention meets its objectives. The relatively light weight and low cost of the subject plate assembly, combined with its inherent internal damping characteristic and structural stability with time, handling and variations in temperature and humidity, enables design and construction of pianos in which parts other than the plate or plate assembly, such as the case, can also be lighter and less expensive than conventional cases. The result is the availability of high quality pianos which are considerably less expensive than prior art pianos of equivalent quality. Further, the pianos designed and built to incorporate the subject plate assembly are conveniently and economically transportable.

Although the subject invention is described and illustrated herein with reference to a preferred embodiment, it will be apparent to those skilled in the art that various alterations, modifications and substitutions may be made without departing from the essential essence of the invention. Accordingly, the scope of the invention is defined by the following claims.

What is claimed is:

1. A piano plate assembly comprising: composite material bars, composite material plate elements and fastenings means, said bars and plate elements being selectively fastened together by said fastening means to form said plate assembly.

2. A plate assembly as claimed in claim 1 wherein said fastening means are bonding agents.

3. A plate assembly as claimed in claim 1 wherein said fastening means comprise metal fasteners.

4. A plate assembly as claimed in claim 1 wherein said fastening means comprise metal fittings and metal fasteners.

5. A plate assembly as claimed in claim 1 wherein said fastening means comprise metal fittings, metal fasteners and bonding agents.

6. A plate assembly as claimed in claim 1, 2, 3, 4 or 5 in which said composite material bars are hollow and made with graphite fibres and resin.

7. A plate assembly as claimed in claim 1, 2, 3, 4, or 5 in which said composite material bars are made with graphite fibres and resin and a mandrel.

8. A plate assembly as claimed in claim 1, 2, 3, 4, or 5 in which said composite material bars are made with graphite fibres and resin and a tubular metal mandrel.

9. A plate assembly as claimed in claim 1, 2, 3, 4, or 5 in which said composite material bars are made with graphite fibres and resin and a plastic mandrel.

10. A plate assembly as claimed in claim 1, 2, 3, 4 or 5 in which said composite material bars are made with graphite fibres and resin and a composite material mandrel.

11. A plate assembly as claimed in claim 1, 2, 3, 4 or 5 in which said composite material bars are hollow and made with graphite fibres and resin and said plate elements are made up of laminations of graphite fibres impregnated with resin, some of said plate elements having hitch pins molded in place and some having holes for tuning pins formed in them.

12. A plate assembly as claimed in claim 1, 2, 3, 4, or 5 in which said composite material bars are made with graphite fibres and resin and a mandrel and said plate elements are made up of laminations of graphite fibres impregnated with resin, some of said plate elements having hitch pins molded in place and some having holes for tuning pins formed in them.

13. A plate assembly as claimed in claim 1, 2, 3, 4, or 5 in which said composite material bars are made with graphite fibres and resin and a tubular metal mandrel and said plate elements are made up of laminations of graphite fibres impregnated with resin, some of said plate elements having hitch pins molded in place and some having holes for tuning pins formed in them.

14. A plate assembly as claimed in claim 1, 2, 3, 4, or 5 in which said composite material bars are made with graphite fibres and resin and a plastic mandrel and said plate elements are made up of laminations of graphite fibres impregnated with resin, some of said plate elements having hitch pins molded in place and some having holes for tuning pins formed in them.

15. A plate assembly as claimed in claim 1, 2, 3, 4 or 5 in which said composite material bars are made with graphite fibres and resin and a composite material mandrel and said plate elements are made up of laminations of graphite fibres impregnated with resin, some of said plate elements having hitch pins molded in place and some having holes for tuning pins formed in them.

16. A plate assembly as claimed in claim 1, 2, 3, 4 or 5 in which said composite material bars are hollow and made with graphite fibres and resin and said plate elements are made up of laminations of grahite fibres impregnated with resin, some of said plate elements having hitch pins molded in place and some having holes for tuning pins formed in them, said hitch pins being molded in place by the method comprising the steps of:

1. Punching holes into said some of said plate elements in their uncured state;
2. Placing said hitch pins in said holes;
3. Holding said hitch pins in proper alignment and locations relative to each other and the plate elements with tooling jigs;
4. Curing the plate elements with the hitch pins in place; and
5. Removing the tooling jigs from the cured plate element having the hitch pins in place.

17. A plate assembly as claimed in claim 1, 2, 3, 4 or 5 in which said composite material bars are made with graphite fibres and resin and a composite material mandrel and said plate elements are made up of laminations of graphite fibres impregnated with resin, some of said plate elements having hitch pins molded in place and some having holes for tuning pins formed in them, said hitch pins being molded in place by the method comprising the steps of:

1. Punching holes into said some of said plate elements in their uncured state;
2. Placing said hitch pins in said holes;
3. Holding said hitch pins in proper alignment and locations relative to each other and the plate elements with tooling jigs;
4. Curing the plate elements with the hitch pins in place; and
5. Removing the tooling jigs from the cured plate element having the hitch pins in place.

18. A plate assembly as claimed in claim 1, 2, 3, 4, or 5 in which said composite material bars are made with graphite fibres and resin and a tubular metal mandrel and said plate elements are made up of laminations of graphite fibres impregnated with resin, some of said plate elements having hitch pins molded in place and some having holes for tuning pins formed in them, said hitch pins being molded in place by the method comprising the steps of:

1. Punching holes into said some of said plate elements in their uncured state;
2. Placing said hitch pins in said holes;
3. Holding said hitch pins in proper alignment and locations relative to each other and the plate elements with tooling jigs;
4. Curing the plate elements with the hitch pins in place; and
5. Removing the tooling jigs from the cured plate element having the hitch pins in place.

19. A plate assembly as claimed in claim 1, 2, 3, 4 or 5 in which said composite material bars are made with graphite fibres and resin and a plastic mandrel and said plate elements are made up of laminations of graphite fibres impregnated with resin, some of said plate elements having hitch pins molded in place and some having holes for tuning pins formed in them, said hitch pins being molded in place by the method comprising the steps of:

1. Punching holes into said some of said plate elements in their uncured state;
2. Placing said hitch pins in said holes;
3. Holding said hitch pins in proper alignment and locations relative to each other and the plate elements with tooling jigs;
4. Curing the plate elements with the hitch pins in place; and
5. Removing the tooling jigs from the cured plate element having the hitch pins in place.

20. A plate assembly as claimed in claim 1, 2, 3, 4 or 5 in which said composite material bars are made with graphite fibres and resin and a composite material mandrel and said plate elements are made up of laminations of graphite fibres impregnated with resin, some of said plate elements having hitch pins molded in place and some having holes for tuning pins formed in them said hitch pins being molded in place by the method comprising the steps of:

1. Punching holes into said some of said plate elements in their uncured state;
2. Placing said hitch pins in said holes;

3. Holding said hitch pins in proper alignment and locations relative to each other and the plate elements with tooling jigs;
4. Curing the plate elements with the hitch pins in place; and
5. Removing the tooling jigs from the cured plate element having the hitch pins in place.

21. A plate assembly as claimed in claim 1, 2, 3, 4 or 5 in which said composite material bars are hollow and made with graphite fibres and resin and said plate elements are made up of laminations of graphite fibres impregnated with resin, some of said plate elements having hitch pins molded in place and some having holes for tuning pins formed in them, said holes being formed in said some of said plate elements by a method comprising the steps of:

1. Punching holes into said some of said plate elements in their uncured state;
2. Placing parts having the desired finished shapes and sizes of the holes into said holes;
3. Holding said parts in the desired alignments and locations relative to each other and the plate elements with tooling jigs;
4. Curing the plate elements with the parts in place; and
5. Removing the tooling jigs and the parts from the cured plate elements.

22. A plate assembly as claimed in claim 1, 2, 3, 4 or 5 in which said composite material bars are made with graphite fibres and resin and a mandrel and said plate elements are made up of laminations of graphite fibres impregnated with resin, some of said plate elements having hitch pins molded in place and some having holes for tuning pins formed in them, said holes being formed in said some of said plate elements by a method comprising the steps of:

1. Punching holes into said some of said plate elements in their uncured state;
2. Placing parts having the desired finished shapes and sizes of the holes into said holes;
3. Holding said parts in the desired alignments and locations relative to each other and the plate elements with tooling jigs;
4. Curing the plate elements with the parts in place; and
5. Removing the tooling jigs and the parts from the cured plate elements.

23. A plate assembly as claimed in claim 1, 2, 3, 4, or 5 in which said composite material bars are made with graphite fibres and resin and a tubular metal mandrel and said plate elements are made up of laminations of graphite fibres impregnated with resin, some of said plate elements having hitch pins molded in place and some having holes for tuning pins formed in them, said holes being formed in said some of said plate elements by a method comprising the steps of:

1. Punching holes into said some of said plate elements in their uncured state;
2. Placing parts having the desired finished shapes and sizes of the holes into said holes;
3. Holding said parts in the desired alignments and locations relative to each other and the plate elements with tooling jigs;
4. Curing the plate elements with the parts in place; and
5. Removing the tooling jigs and the parts from the cured plate elements.

24. A plate assembly as claimed in claim 1, 2, 3, 4, or 5 in which said composite material bars are made with graphite fibres and resin and a plastic mandrel and said plate elements are made up of laminations of graphite fibres impregnated with resin, some of said plate elements having hitch pins molded in place and some having holes for tuning pins formed in them, said holes being formed in said some of said plate elements by a method comprising the steps of:

1. Punching holes into said some of said plate elements in their uncured state;
2. Placing parts having the desired finished shapes and sizes of the holes into said holes;
3. Holding said parts in the desired alignments and locations relative to each other and the plate elements with tooling jigs;
4. Curing the plate elements with the parts in place; and
5. Removing the tooling jigs and the parts from the cured plate elements.

25. A plate assembly as claimed in claim 1, 2, 3, 4 or 5 in which said composite material bars are made with graphite fibres and resin and a composite material mandrel and said plate elements are made up of laminations of graphite fibres impregnated with resin, some of said plate elements having hitch pins molded in place and some having holes for tuning pins formed in them, said holes being formed in said some of said plate elements by a method comprising the steps of:

1. Punching holes into said some of said plate elements in their uncured state;
2. Placing parts having the desired finished shapes and sizes of the holes into said holes;
3. Holding said parts in the desired alignments and locations relative to each other and the plate elements with tooling jigs;
4. Curing the plate elements with the parts in place; and
5. Removing the tooling jigs and the parts from the cured plate elements.

26. A plate assembly as claimed in claim 1, 2, 3, 4 or 5 in which said composite material bars are made with graphite fibres and resin and a mandrel and said plate elements are made up of laminations of graphite fibres impregnated with resin, some of said plate elements having hitch pins molded in place and some having holes for tuning pins formed in them, said hitch pins being molded in place by the method comprising the steps of:

1. Punching holes into said some of said plate elements in their uncured state;
2. Placing said hitch pins in said holes;
3. Holding said hitch pins in proper alignment and locations relative to each other and the plate elements with tooling jigs;
4. Curing the plate elements with the parts in place; and
5. Removing the tooling jigs from the cured plate elements having the hitch pins in place, and said holes being formed in said some of said plate elements by the method comprising the steps of:

1. Punching holes into said some of said plate elements in their uncured state;
2. Placing parts having the desired finished shapes and sizes of the holes into said holes;
3. Holding said parts in the desired alignments and locations relative to each other and the plate elements with tooling jigs;

4. Curing the plate elements with the parts in place; and
5. Removing the tooling jigs and the parts from the cured plate elements.

27. A plate assembly as claimed in claim 1, 2, 3, 4, or 5 in which said composite material bars are made with graphite fibres and resin and a tubular metal mandrel and said plate elements are made up of laminations of graphite fibres impregnated with resin, some of said plate elements having hitch pins molded in place and some having holes for tuning pins formed in them, said hitch pins being molded in place by the method comprising the steps of:

1. Punching holes into said some of said plate elements in their uncured state;
2. Placing said hitch pins in said holes; p1 3. Holding said hitch pins in proper alignment and locations relative to each other and the plate elements with tooling jigs;
4. Curing the plate elements with the parts in place; and
5. Removing the tooling jigs from the cured plate elements having the hitch pins in place, and said holes being formed in said some of said plate elements by the method comprising the steps of:
1. Punching holes into said some of said plate elements in their uncured state;
2. Placing parts having the desired finished shapes and sizes of the holes into said holes;
3. Holding said parts in the desired alignments and locations relative to each other and the plate elements with tooling jigs;
4. Curing the plate elements with the parts in place; and
5. Removing the tooling jigs and the parts from the cured plate elements.

28. A plate assembly as claimed in claim 1, 2, 3, 4, or 5 in which said composite material bars are made with graphite fibres and resin and a plastic mandrel and said plate elements are made up of laminations of graphite fibres impregnated with resin, some of said plate elements having hitch pins molded in place and some having holes for tuning pins formed in them, said hitch pins being molded in place by the method comprising the steps of:

1. Punching holes into said some of said plate elements in their uncured state;
2. Placing said hitch pins in said holes;
3. Holding said hitch pins in proper alignment and locations relative to each other and the plate elements with tooling jigs;
4. Curing the plate elements with the parts in place; and
5. Removing the tooling jigs from the cured plate elements having the hitch pins in place, and said holes being formed in said some of said plate elements by the method comprising the steps of:
1. Punching holes into said some of said plate elements in their uncured state;
2. Placing parts having the desired finished shapes and sizes of the holes into said holes;
3. Holding said parts in the desired alignments and locations relative to each other and the plate elements with tooling jigs;
4. Curing the plate elements with the parts in place; and
5. Removing the tooling jigs and the parts from the cured plate elements.

29. A plate assembly as claimed in claim 1, 2, 3, 4 or 5 in which said composite material bars are made with graphite fibres and resin and a composite material mandrel and said plate elements are made up of laminations of graphite fibres impregnated with resin, some of said plate elements having hitch pins molded in place and some having holes for tuning pins formed in them, said hitch pins being molded in place by the method comprising the steps of:

1. Punching holes into said some of said plate elements in their uncured state;
2. Placing said hitch pins in said holes;
3. Holding said hitch pins in proper alignment and locations relative to each other and the plate elements with tooling jigs;
4. Curing the plate elements with the parts in place; and
5. Removing the tooling jigs from the cured plate elements having the hitch pins in place, and said holes being formed in said some of said plate elements by the method comprising the steps of:
1. Punching holes into said some of said plate elements in their uncured state;
2. Placing parts having the desired finished shapes and sizes of the holes into said holes;
3. Holding said parts in the desired alignments and locations relative to each other and the plate elements with tooling jigs;
4. Curing the plate elements with the parts in place; and
5. Removing the tooling jigs and the parts from the cured plate elements.

30. A plate assembly as claimed in claim 1, 2, 3, 4 or 5 in which said composite material bars are hollow and made with graphite fibres and resin and said plate elements are made up of laminations of graphite fibres impregnated with resin, some of said plate elements having hitch pins molded in place and some having holes for tuning pins formed in them, said hitch pins being molded in place by the method comprising the steps of:

1. Punching holes into said some of said plate elements in their uncured state;
2. Placing said hitch pins in said holes;
3. Holding said hitch pins in proper alignment and locations relative to each other and the plate elements with tooling jigs;
4. Curing the plate elements with the parts in place; and
5. Removing the tooling jigs from the cured plate elements having the hitch pins in place, and said holes being formed in said some of said plate elements by the method comprising the steps of:
1. Punching holes into said some of said plate elements in their uncured state;
2. Placing parts having the desired finished shapes and sizes of the holes into said holes;
3. Holding said parts in the desired alignments and locations relative to each other and the plate elements with tooling jigs;
4. Curing the plate elements with the parts in place; and
5. Removing the tooling jigs and the parts from the cured plate elements.

31. A plate assembly as claimed in claim 1, 2, 3, 4 or 5 further comprising at least one capo d'astro element comprising material laminated around a core made of material which has high internal damping and high specific gravity.

32. A plate assembly as claimed in claim 1, 2, 3, 4 or 5 further comprising at least one capo d'astro element comprising composite material laminated around a core made of lead.

33. A plate assembly as claimed in claim 1, 2, 3, 4 or 5 further comprising at least one capo d'astro element comprising composite material laminated around a core made of plastic filled with lead particles.

* * * * *